US005880672A

United States Patent [19]

Weaver

[11] Patent Number: 5,880,672

[45] Date of Patent: Mar. 9, 1999

[54] EMERGENCY INDICATOR SYSTEM

[76] Inventor: Edward Weaver, 248 Howe Rd., Greenfield, N.Y. 12833

[21] Appl. No.: 847,104

[22] Filed: Nov. 13, 1996

[51] Int. Cl.[6] ..... G08B 5/00

[52] U.S. Cl. ..... 340/332; 340/326; 340/693.9; 340/691.5; 379/37; 379/38; 379/45

[58] Field of Search ..... 340/332, 326, 340/691, 693, 539, 815.73, 331; 379/37, 38, 45

[56] References Cited

U.S. PATENT DOCUMENTS

| | | | |
|---|---|---|---|
| 3,913,092 | 10/1975 | Klingenberg | 340/332 |
| 4,003,040 | 1/1977 | Browand | 340/332 |
| 4,547,761 | 10/1985 | Jones | 340/332 |
| 4,736,186 | 4/1988 | Jones | 340/332 |
| 4,878,236 | 10/1989 | Ray et al. | 340/332 |
| 4,931,780 | 6/1990 | LaMont et al. | 379/37 |
| 4,935,951 | 6/1990 | Robinson et al. | 340/332 |
| 4,993,058 | 2/1991 | McMinn et al. | 340/332 |
| 5,012,507 | 4/1991 | Leighton et al. | 379/37 |
| 5,177,461 | 1/1993 | Budzyna et al. | 340/332 |
| 5,453,729 | 9/1995 | Chu | 340/332 |
| 5,636,263 | 6/1997 | Thomson | 379/45 |

*Primary Examiner*—Jeffery A. Hofsass
*Assistant Examiner*—Sihong Huang
*Attorney, Agent, or Firm*—Michael I. Kroll

[57] ABSTRACT

An emergency indicator system which comprises a telephone located within a building and a visual display unit. A facility electrically connected to the telephone is for activating the visual display unit, when a person dials 911 on the telephone during an emergency, so that the building can be quickly located, such as by an emergency rescue vehicle, the police, etc.

1 Claim, 5 Drawing Sheets

EMERGENCY INDICATOR SYSTEM

BACKGROUND OF THE INVENTION

1. Field of the Invention

The instant invention relates generally to locator devices and more specifically it relates to an emergency indicator system.

2. Description of the Prior Art

Numerous locator devices have been provided in prior art that are adapted to help people find different places and various objects that are lost or in need of help. While these units may be suitable for the particular purpose to which they address, they would not be as suitable for the purposes of the present invention as heretofore described.

SUMMARY OF THE INVENTION

A primary object of the present invention is to provide an emergency indicator system that will overcome the shortcomings of the prior art devices.

Another object is to provide an emergency indicator system that will visually display a number of a building when 911 is dialed on a telephone, so that an emergency rescue truck, the police or a fire engine can quickly locate the building.

An additional object is to provide an emergency indicator system in which the visual display can be in a window, on an external wall of the building, or remotely placed at the curb side of the street.

A further object is to provide an emergency indicator system that is simple and easy to use.

A still further object is to provide an emergency indicator system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
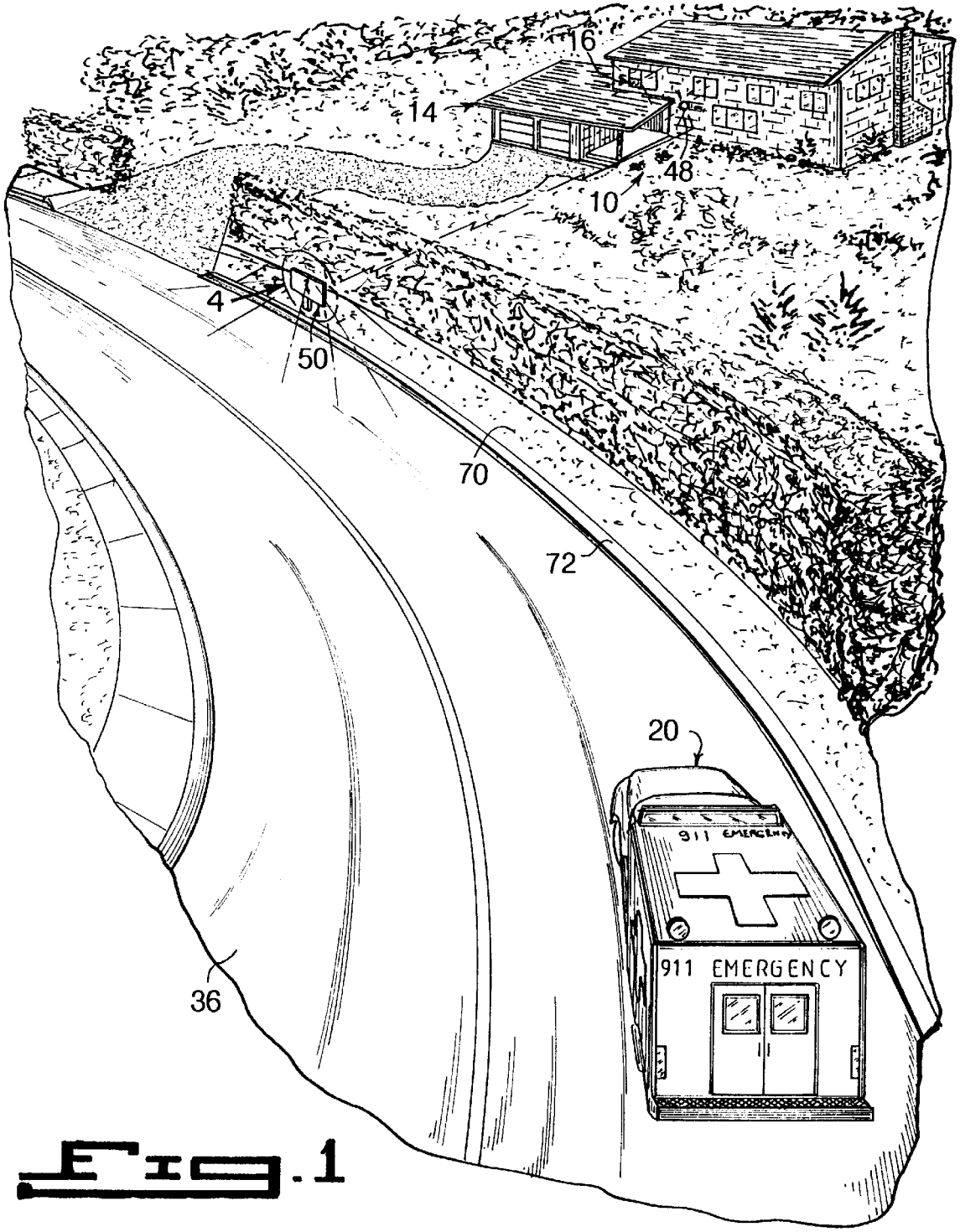
FIG. 1 is a perspective view of a building on a street with the instant invention installed and in use, to alert an emergency rescue vehicle coming down the street.
Figure 2:
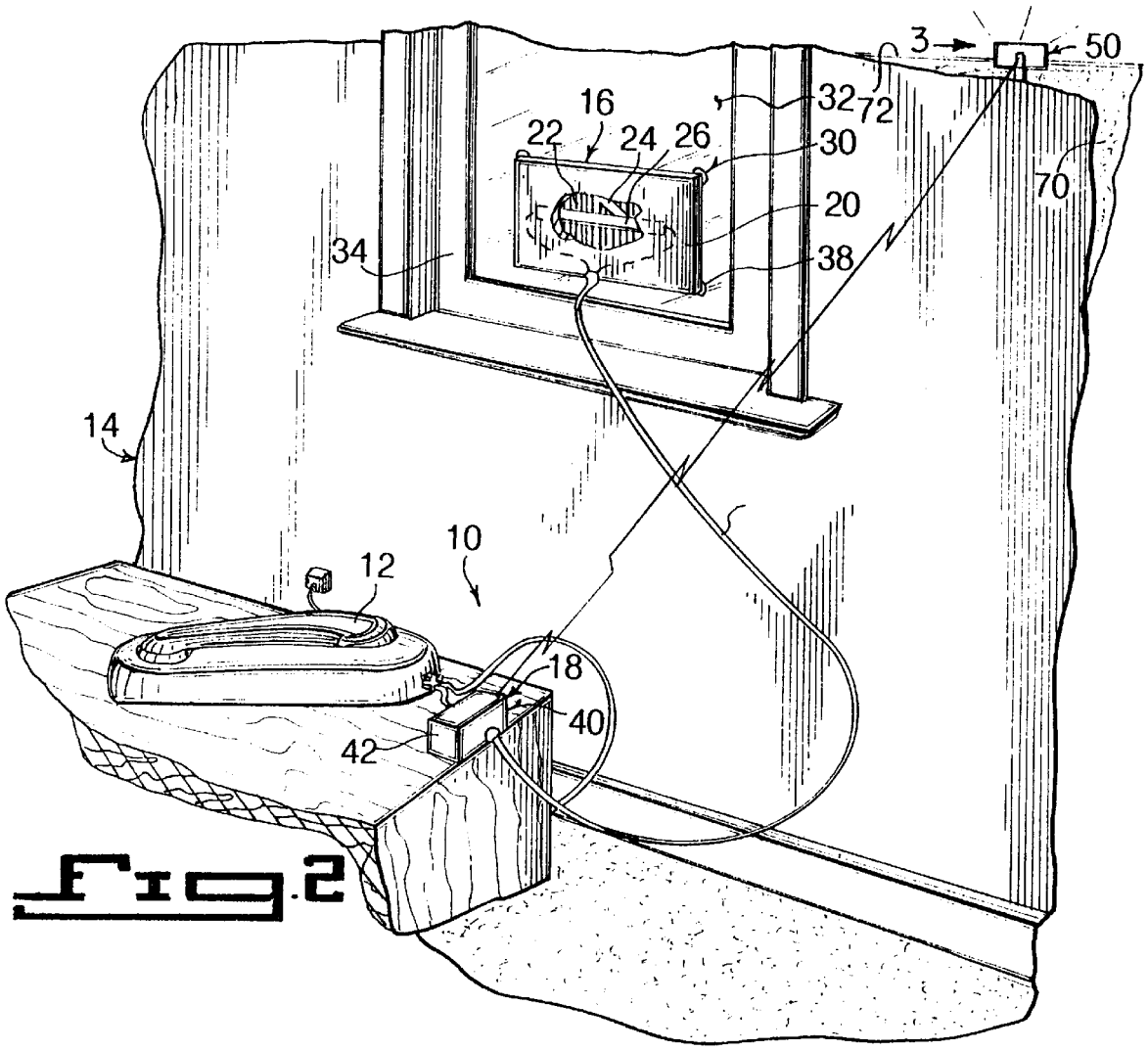
FIG. 2 is a perspective view with parts broken away of the interior of the building, showing the various components of the instant invention.
Figure 3:
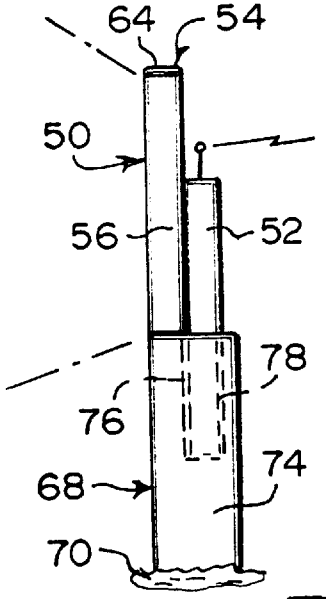
FIG. 3 is a side view taken in the direction of arrow 3 in FIG. 2 of the remote visual display unit.
Figure 4:
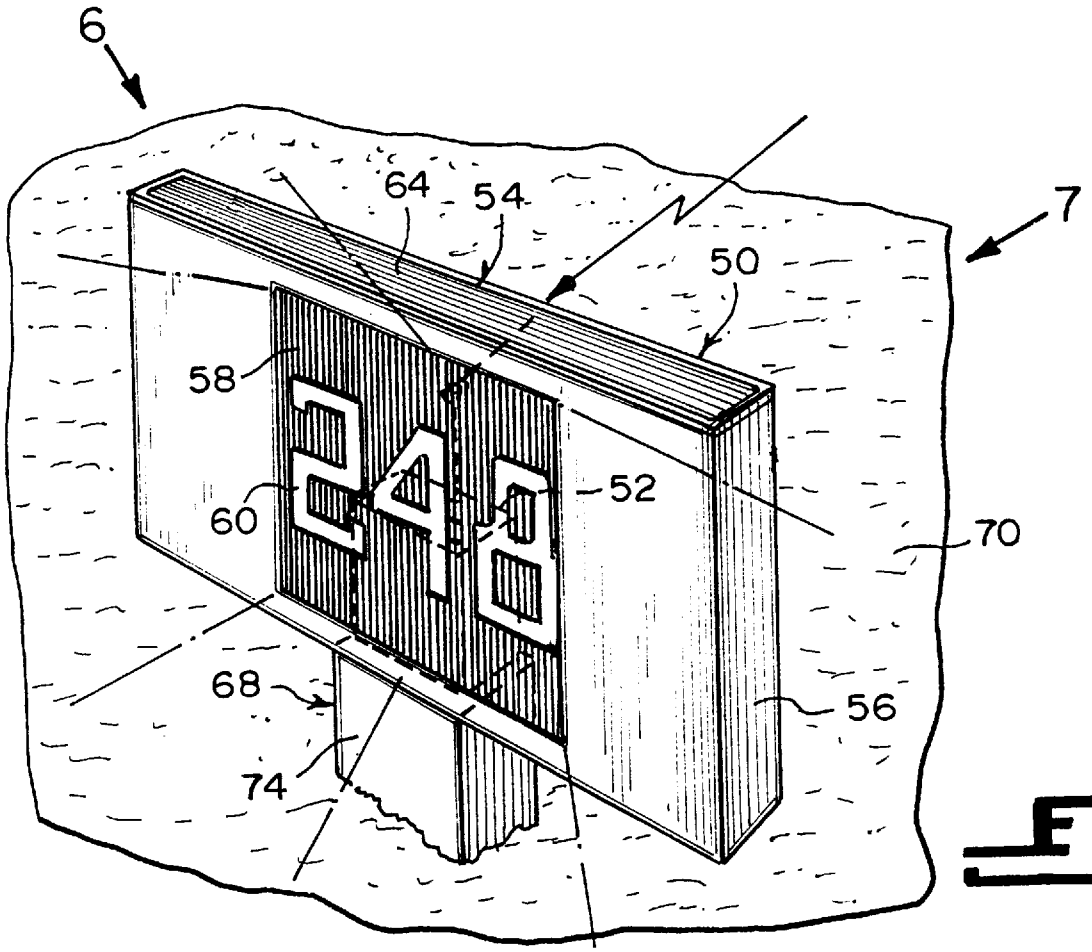
FIG. 4 is an enlarged front perspective view of the remote visual display unit as indicated by arrow 4 in FIG. 1.
Figure 5:
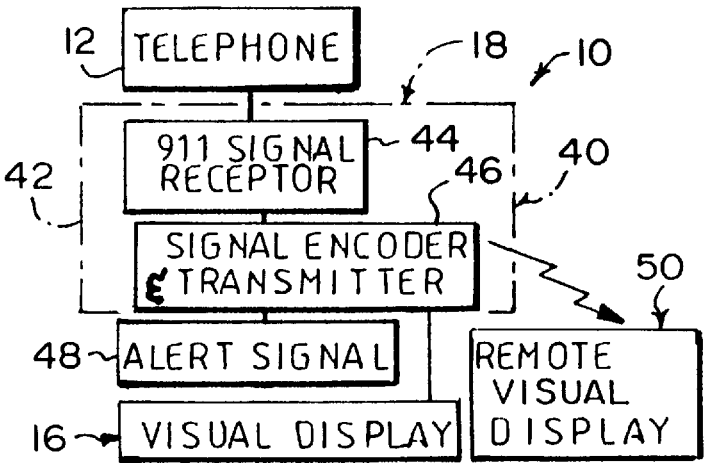
FIG. 5 is a block diagram of the instant invention.
Figure 6:
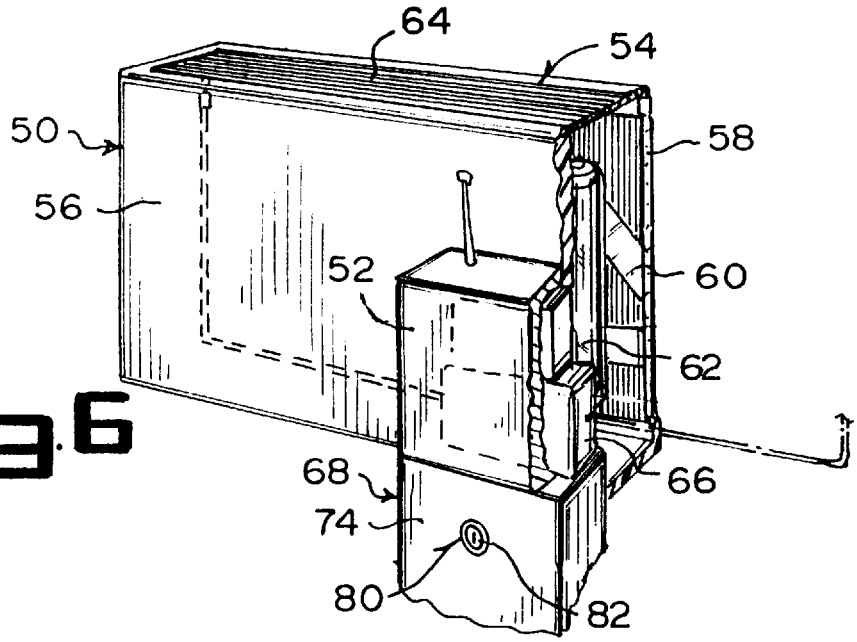
FIG. 6 is a rear perspective view of the remote visual display unit taken in the direction of arrow 6 in FIG. 4, with parts broken away and in section.
Figure 7:
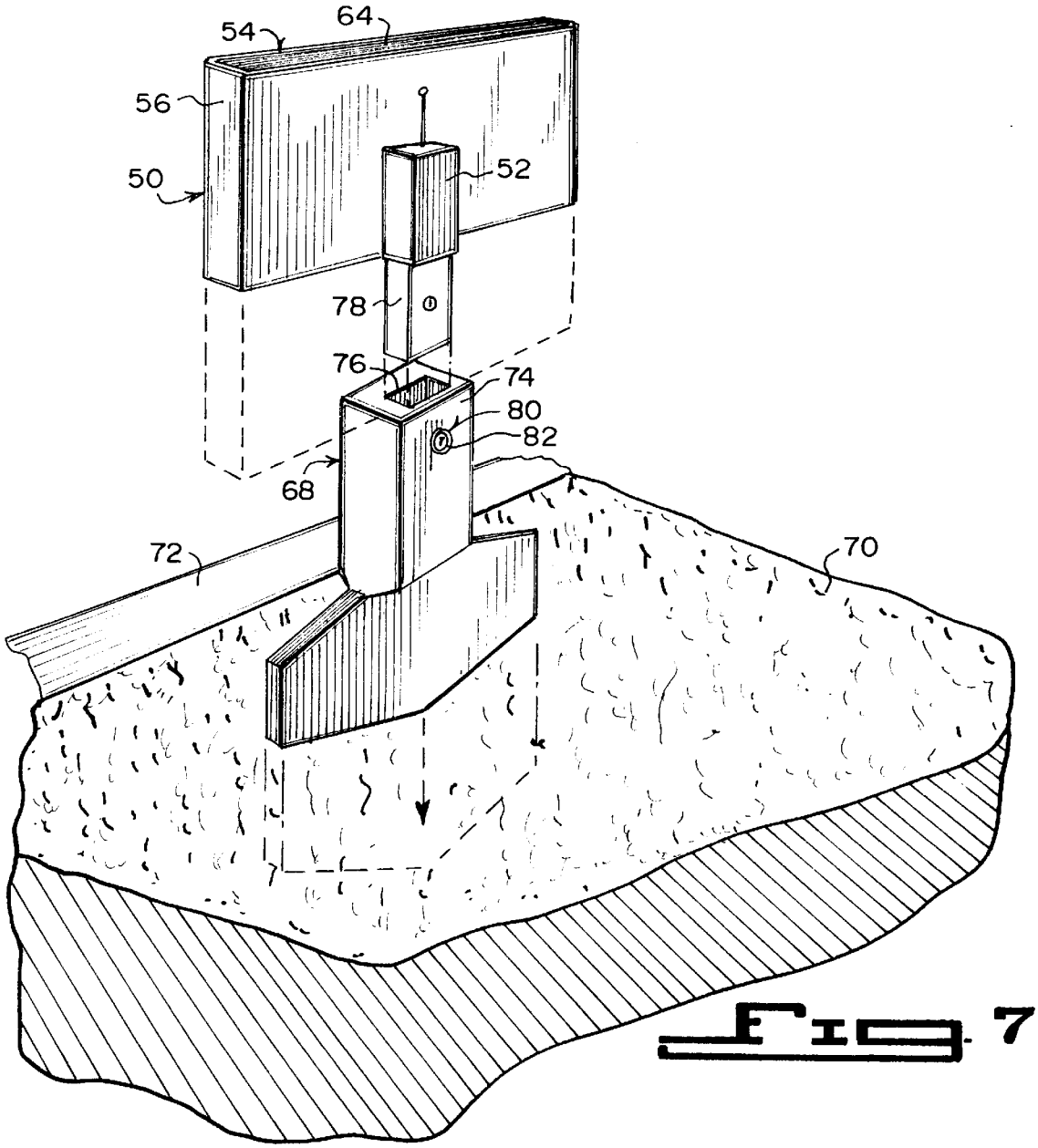
FIG. 7 is a rear exploded perspective view of the remote visual display unit taken in the direction of arrow 7 in FIG. 4.

Turning now descriptively to the drawings, in which similar reference characters denote similar elements throughout the several views, FIGS. 1, 2 and 5 illustrate an emergency indicator system 10, which comprises a telephone 12 located within a building 14. A visual display unit 16 is also provided. A facility 18 electrically connected to the telephone 12, is for activating the visual display unit 16, when a person dials 911 on the telephone 12 during an emergency, so that the building 14 can be quickly located, such as by an emergency rescue vehicle 20, the police, etc.

The visual display unit 16 as best seen in FIG. 2, includes a box-shaped housing 20. A front panel 22 has transparent numerals 24 thereon. The front panel 22 is secured to the housing 20. A lamp 26 is carried with the housing 20 behind the front panel 22. An elongated electrical cord 28 is connected between the lamp 24 and the activating facility 18.

Components 30 are for securing the visual display unit 16 to an interior surface 32 of a window 34 in the building 14, so as to be seen in the window 34 from the street 36. The securing components 30 are a plurality of suction cups 38 affixed to a front surface of the visual display unit 16. The suction cups 38 can stick to the interior surface 32 of the window 34 in the building 14.

The activating facility 18 is a signal converter device 40 electrically connected between the telephone 12 and the visual display unit 16. When the person dials 911 on the telephone 12, the signal converter device 40 will recognize those specific dialed numbers and then activate the visual display unit 16.

The signal converter device 40, as shown in FIG. 5, consists of an enclosure 42. A 911 signal receptor 44 within the enclosure 42 is electrically connected to the telephone 12. A signal encoder and transmitter 46 within the enclosure 42 is electrically connected between the 911 signal receptor 44 and the visual display unit 16.

An audible alert signal unit 48 is electrically connected to the activating facility 18. When the audible alert signal unit 48 is turned on it will make a sound to help locate the building 14. A remote visual display unit 50 away from the building 14 can be turned on by the activating facility 18 which is located within the build 14, so as to help locate the building 14 quickly during the emergency.

The remote visual display unit 50, as shown in FIGS. 1 through 7, includes a receiver 52 to receive signals from the signal encoder and transmitter 46 of the signal converter device 40. A power source 54 operates the receiver 52. A box-shaped casing 56 is connected to a front face of the receiver 52. A front panel 58 has transparent numerals 60 thereon. The front panel 58 is secured to the casing 56. A lamp 62 is carried within the casing 56 behind the front panel 58 and is electrically connected to the receiver 52.

The power source 54 consists of a solar panel 64 on a top surface of the box-shaped casing 56. A rechargeable battery 66 is electrically connected to the solar panel 64.

An assembly 68 is for mounting the remote visual display unit 50 above the ground 70 away from the building 14 at the curb side 72 of the street 36. The mounting assembly 68 contains a breakaway post 74, having a top socket 76 therein. A plug 78 extends downwardly from the receiver 52. The plug 78 can fit into the top socket 76 of the post 74. An element 80 is for retaining the plug 78 within the top socket 76 of the post 74. The retaining element 80 is a key operated lock 82 on the post 74 that engages with the plug.

Operation of the Invention

To use the emergency indicator system 10, the following steps should be taken:

1. Lift up the headset of the telephone 12 and dial 911 during an emergency.
2. The 911 signal receptor sends the signal into the signal encoder and transmitter 46.
3. The transparent numerals 24 in the front panel 22 are then illuminated by the lamp 26, which is turned on by the signal encoder and transmitter 46.
4. The audible alert signal unit 48 is also turned on by the signal encoder and transmitter 46, to sound an alarm.
5. The signal encoder and transmitter 46 will also send a signal to the receiver 52 in the remote visually display unit 50 at the curb side 72 of the street 36.
6. The lamp 62 is turned on to illuminate the transparent numerals 60, so that the building 14 can be located quickly.

LIST OF REFERENCE NUMBERS

10 emergency indicator system
12 telephone of 10
14 building
16 visual display unit of 10
18 activating facility of 10
20 box-shaped housing of 16
22 front panel of 16
24 transparent numeral on 22
26 lamp of 16
28 elongated electrical cord of 16
30 securing component of 16
32 interior surface of 34
34 window in 14
36 street
38 suction cup for 30
40 signal converter device for 18
42 enclosure of 40
44 911 signal receptor of 40
46 signal encoder and transmitter of 40
48 audible alert signal unit of 10
50 remote visual display unit of 10
52 receiver in 50
54 power source in 50
56 box-shaped casing of 50
58 front panel of 50
60 transparent numerals on 58
62 lamp of 50
64 solar panel of 54
66 rechargeable battery of 54
68 mounting assembly for 50
70 ground
72 curb side of 36
74 breakaway post of 68
76 tp socket in 74
78 plug of 68
80 retaining element
82 key operated lock for 80

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An emergency indicator system which comprises:

a) a telephone located within a building having a service telephone line connected thereto:

b) a visual display unit including a box-shaped housing, a front panel having transparent numerals thereon secured to said housing, a lamp carried within said housing behind said front panel, and means comprising suction cups for securing said visual display unit to an interior surface of a window in the building visible from the street;

c) means electrically connected between said telephone independent of said telephone service line and said display unit for activating said visual display unit including an elongated electrical cord connected between said lamp and said activating means when a person dials 911 on said telephone during an emergency, so that the building can be quickly located;

d) said activating means including a signal converter device comprising an enclosure, a 911 signal receptor within said enclosure electrically connected to said telephone, and a signal encoder and transmitter within said enclosure electrically connected between said 911 signal receptor and said visual display unit and for also issuing a radio signal when activated;

e) an audible alert signal unit electrically connected to said activating means for generating a sound to help locate the building;

f) a remote visual display unit away from the building that can be turned on by said activating means to help locate the building quickly during the emergency, said remote visual display unit comprising a receiver to receive signals from said signal encoder and transmitter, a box-shaped casing connected to a front face of said receiver, a power source to operate said receiver including a solar panel on a top surface of said casing and a rechargeable battery electrically connected to said solar panel, a front panel having transparent numerals thereon secured to said casing, and a lamp carried within said casing behind said front panel and electrically connected to said receiver; and g) means for mounting said remote visual display unit above the ground away from the building at the curb side of the street comprising a breakaway post having a top socket therein, a plug extending downwardly from said receiver for being fitted into said top socket, and means for retaining said plug within said top socket comprising a key operated lock on said post that engages with said plug.

* * * * *